United States Patent [19]

Hall et al.

[11] 4,166,502

[45] Sep. 4, 1979

[54] HIGH VERTICAL CONFORMANCE STEAM DRIVE OIL RECOVERY METHOD

[75] Inventors: Wilbur L. Hall, Bellaire; Alfred Brown, Houston; Ralph J. Korstad, Austin, all of Tex.

[73] Assignee: Texaco Inc., White Plains, N.Y.

[21] Appl. No.: 936,558

[22] Filed: Aug. 24, 1978

[51] Int. Cl.[2] ..... E21B 43/24

[52] U.S. Cl. ..... 166/263; 166/245; 166/261; 166/269; 166/272

[58] Field of Search ..... 166/263, 272, 269, 245, 166/261, 306, 252, 274

[56] References Cited

U.S. PATENT DOCUMENTS

| | | | |
|---|---|---|---|
| 2,862,558 | 12/1958 | Dixon | 166/272 |
| 3,252,512 | 5/1966 | Baker et al. | 166/263 |
| 3,406,755 | 10/1968 | Sharp | 166/272 X |
| 3,412,794 | 11/1968 | Craighead | 166/272 |
| 3,465,823 | 9/1969 | Jacoby et al. | 166/263 |
| 3,822,748 | 7/1974 | Allen et al. | 166/269 |
| 3,878,892 | 4/1975 | Allen et al. | 166/274 X |
| 4,088,188 | 5/1978 | Widmyer | 166/269 |
| 4,109,723 | 8/1978 | Widmyer | 166/263 X |
| 4,114,690 | 9/1978 | Cram et al. | 166/272 |
| 4,124,071 | 11/1978 | Allen et al. | 166/272 |

*Primary Examiner*—Stephen J. Novosad

*Attorney, Agent, or Firm*—Carl G. Ries; Thomas H. Whaley; Jack H. Park

[57] ABSTRACT

The vertical conformance of a steam drive process is improved and steam override reduced by penetrating the zone between one injector and one producer, with an infill well located between the injector and producer which is in fluid communication with no more than the bottom half of the formation. Steam is injected into the injection well in the first phase with production of fluids from the upper ⅓ or less of the formation via the production well. A separate flow path in communication with the bottom ⅓ or less of the formation is provided in the producing well, and is used during the first phase for push-pull treatment of the formation with solvent and steam or hot water. After production via the production well is terminated, petroleum is produced via the infill well until the fluid being produced from the infill well reaches 95 percent water cut, after which the infill well is converted from a producer to an injector and hot water is injected into the lower portion of the formation via the infill well and fluids are produced from the production well. After water breakthrough at the production well, steam is injected into the infill well and fluids are recovered from the lower ⅓ of the production well.

20 Claims, 6 Drawing Figures

HIGH VERTICAL CONFORMANCE STEAM DRIVE OIL RECOVERY METHOD

FIELD OF THE INVENTION

The present invention concerns a steam throughput or steam drive oil recovery method. More particularly, the present invention involves an improved steam drive oil recovery method especially suitable for use in relatively thick, viscous oil-containing formations, in which steam override which causes poor vertical conformance is greatly reduced.

BACKGROUND OF THE INVENTION

It is well recognized by persons skilled in the art of oil recovery that there are formations which contain petroleum whose viscosity is so great that little or no primary production is possible. Some form of supplemental oil recovery must be applied to these formations which decreases the viscosity of the petroleum sufficiently that it will flow or can be displaced through the formation to production wells and therethrough to the surface of the earth. Thermal recovery techniques are quite suitable for viscous oil formations, and steam flooding is the most successful thermal oil recovery technique yet employed commercially. Steam may be utilized for thermal stimulation for viscous oil formations by means of a "huff and puff" technique in which steam is injected into a well, allowed to remain in the formation for a soak period, and then oil is recovered from the formation by means of the same well as was used for steam injection. Another technique employing steam stimulation is a steam drive or steam throughput process, in which steam is injected into the formation on a more or less continuous basis by means of an injection well and oil is recovered from the formation from a spaced-apart production well. This technique is somewhat more effective than the "huff and puff" steam stimulation process since it both reduces the viscosity of the petroleum and displaces petroleum through the formation, thus effecting recovery at greater distances into the formation than is possible in the "huff and puff" method. While this process is very effective with respect to the portions of the recovery zone between the injection well and production well through which the steam travels, poor vertical and horizontal conformance is often experienced in steam drive oil recovery processes. A major cause of poor vertical conformance is caused by steam, being of lower density than other fluids present in the permeable formation, migrating to the upper portion of the permeable formation and channeling across the top of the oil formation to the remotely located production well. Once steam channeling has occurred in the upper portion of the formation, the permeability of the steam-swept zone is increased due to the desaturation or removal of petroleum from the portions of the formation through which steam has channeled. Thus subsequently-injected steam will migrate almost exclusively through the steam-swept channel and very little of the injected steam will move into the lower portions of the formation, and thus very little additional petroleum from the lower portions of the formation will be experienced. While steam drive processes effectively reduce the oil saturation in the portion of the formation through which they travel by a significant amount, a portion of the recovery zone between the injection and production systems actually contacted by steam is often less than 50 percent of the total volume of that recovery zone, and so a significant amount of oil remains in the formation after completion of the steam drive oil recovery process. The severity of the poor vertical conformance problem increases with the thickness of the oil formation and with the viscosity of the petroleum contained in the oil formation.

In view of the foregoing discussion, and the large deposits of viscous petroleum from which only a small portion can be recovered because of the poor conformance problem, it can be appreciated that there is a serious need for a modified steam drive thermal oil recovery method suitable for use in recovering viscous petroleum from relatively thick formations which will result in improved vertical conformance.

SUMMARY OF THE INVENTION

The process of our invention involves a multi-step process involving at least one injection well and at least one spaced-apart production well for injecting steam into the formation and recovering petroleum from the formation as is done in the current practice of state-of-the-art steam drive oil recovery processes. A third well, referred to herein as an infill well, is drilled into the formation between injection and production wells and fluid communication between the well and the formation is established with only the lower 50 percent and preferably the lower 25 percent of the viscous oil formation. This well may be completed at the same time the primary injection well and production well are completed, or it may be completed in the formation when it is needed. The injection well is completed in a conventional manner, such as by perforating the well throughout the full or a substantial amount of the vertical thickness of the formation. The production well is completed with two separate flow means, one between the surface and the lower $\frac{1}{3}$ or less of the vertical thickness of the formation, and the other being in communication with the upper $\frac{2}{3}$ or less of the vertical thickness of the formation. Steam is injected into the injection well and petroleum is recovered from the upper perforations in the production well until steam breakthrough at the production well occurs. During the first phase when steam is being injected into the injection well and fluids are being produced from the production well via the communication path open to the upper $\frac{2}{3}$ or less of the formation, a solvent injection-production process is applied by the flow path of the production well in communication with the lower $\frac{1}{3}$ of the formation. This process is preferably applied simultaneously with the steam drive process in a series of repetitive cycles throughout the entire time that the steam drive sequence is being applied. The solvent push-pull process comprises a plurality of cycles, each comprising injecting a solvent for the formation petroleum alone or in combination with steam or hot water, into the bottom of the formation until the injection pressure rises to a predetermined level, which should be less than the pressure which will cause fracture of the formation and/or overburden formation. Once the predetermined pressure has been reached, or when a predetermined volume of solvent has been injected, solvent injection is stopped and fluid production is taken from the bottom of the formation by backflow. Oil and solvent flow from the bottom of the formation back into the lower perforations in the producing well until the pressure has declined and/or the fluid production rate declines to a predetermined level. Solvent injection is again applied followed by another period of production of solvent and oil. Each repetitive cycle accomplishes greater depth of penetration into the formation, thereby enlarging the zone in which petroleum saturation has been decreased and consequently permeability has been increased. This zone is located between the bottom of the production well and the bottom of the infill well. Once steam breakthrough occurs at the top of the production well, the solvent push-pull process being applied at the bottom of the production well is terminated. At this time, as little as 50 percent or less of the formation will have been swept by steam due to steam channeling through the upper portions of the formation. Next, steam injection into the injection well is continued and production of petroleum is taken from the infill well, which recovers oil from the lower portion of the formation between the primary injection well and the infill well. This step is continued until the fluid being recovered from the infill well reaches about 95 percent water (referred to in the art as 95 percent water cut). At this point, the infill well is converted from production well service to injection well service and hot water is then injected into the infill well. Because the specific gravity of the hot water injected into the infill well is greater than the specific gravity of steam, and about equal to or greater than the specific gravity of the viscous oil present in the unswept portion of a formation, the hot liquid-phase water passes into and through the lower portion of the formation, and displaces oil therefrom toward the production well. The zone of decreased oil saturation and increased permeability adjacent to the bottom of the production well, created in the solvent push-pull process described above, ensures that the hot water injected into the infill well flows across the bottom of the formation between the infill well and the production well. This results in recovering viscous petroleum from the lower portion of that portion of the recovery zone between the infill well and the production well, which would ordinarily not be swept by steam. Once the water cut of the fluid being produced from the bottom of the production well reaches a value of about 95 percent, injection of hot water into the infill well is terminated and steam injection into the infill well is begun. During the period when the infill well is used for fluid production, injection of steam into the original injection well is continued and fluid production from the original production well may also be continued. During the period when hot water or steam is being injected into the formation via the infill well, steam or water (cold or hot, preferably hot) must be injected into the original injection well to maintain a positive pressure gradient from injector to infill to producer, in order to avoid resaturation of the zone between the injector and infill well. Steam injection into the infill well is continued until live steam production at the production well occurs. The vertical conformance of the steam drive process is improved significantly by application of this process.

DESCRIPTION OF THE PREFERRED EMBODIMENTS

Figure 1:
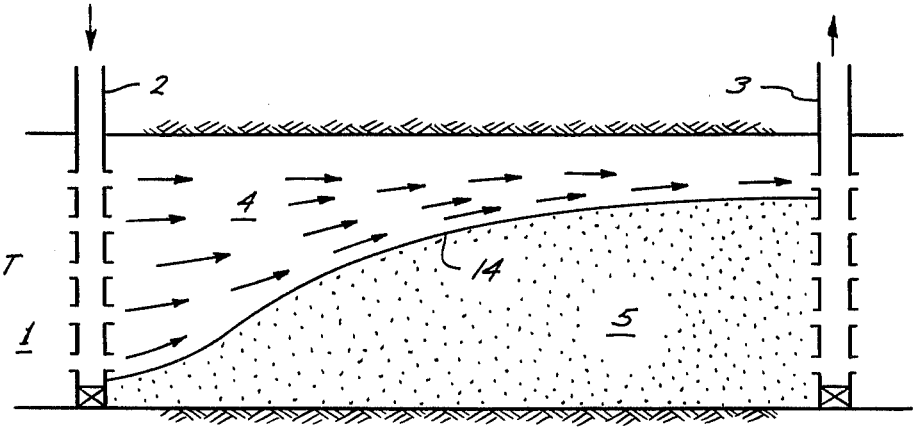
Fig. 1 PRIOR ART
FIG. 1 illustrates a subterranean formation penetrated by an injection well and a production well being employed in a state-of-the-art steam drive oil recovery method, illustrating how the injected steam migrates to the upper portions of the formation as it travels through the recovery zone within the formation and between the injection well and production well, thus bypassing a significant amount of petroleum in the recovery zone.

The process of our invention may best be understood by referring to the attached drawings, in which FIG. 1 illustrates how a relatively thick, viscous oil formation 1 penetrated by an injection well 2 and a production well 3 is used for a conventional steam drive oil recovery process, according to the prior art teachings. Steam is injected into well 2, passes through the perforations in well 2 into the viscous oil formation. Conventional practice is to perforate or establish fluid flow communications between the well and the formation throughout the full vertical thickness of the formation, in both injection well 2 and production well 3. Not withstanding the fact that steam is injected into the full vertical thickness of the formation, it can be seen that steam migrates both horizontally and in an upward direction as it moves through the formation between injection well 2 and production well 3. The result is the creation of a steam-swept zone 4 in the upper portion of the formation from which most of the oil production has been obtained, and zone 5 in the lower portion of the formation through which little or no steam has passed, and from which little or no oil has been recovered. Once steam breakthrough at production well 3 occurs, continued injection of steam will not cause any steam to flow through section 5, because (1) the specific gravity of the substantially all vapor phase steam is significantly less than the specific gravity of the petroleum and other liquids present in the pore spaces of the formation, and so gravitational effects will cause the steam vapors to be confined exclusively in the upper portion of the formation, and (2) steam passage through the upper portion of the formation displaces and removes petroleum from that portion of the formation through which it travels, and desaturation of the zone increases the relative permeability of the formation significantly as a consequence of removing the viscous petroleum therefrom. Thus any injected fluid will travel more readily through the desaturated zone portion of the formation 4 than it will through the portion of the formation 5 which is near original conditions with respect to viscous petroleum saturation.

Figure 2:
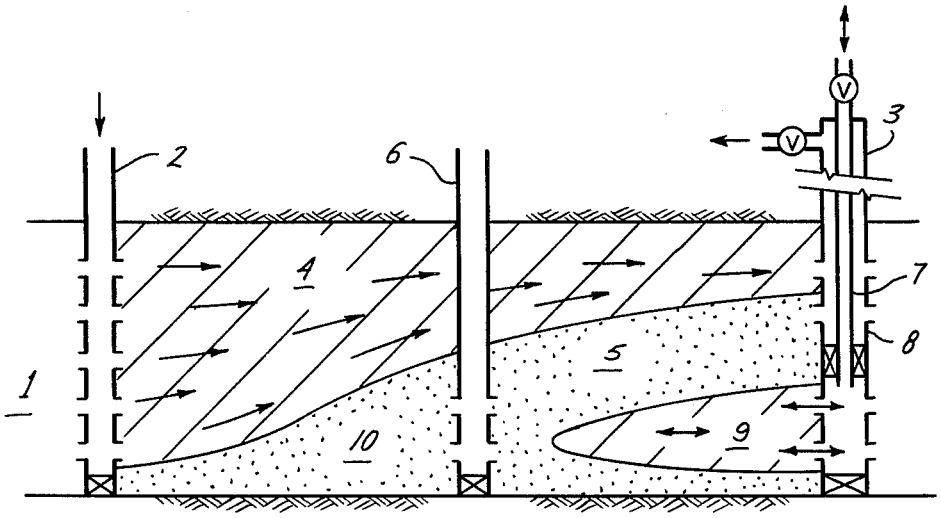
FIG. 2 illustrates the location of an infill well between an injector and producer and the first phase of our process involving steam injection and oil production from the top of the producer with simultaneous solvent push-pull in the bottom of the producer.

FIG. 2 illustrates how infill well 6 is drilled into the formation, with respect to injection well 2 and production well 3. Infill well 6 must be drilled into the recovery zone within the formation defined by injection well 2 and production well 3. It is not essential that infill well 6 be located on a line between injection well 2 and production well 3, and may be offset in either direction from a straight line arrangement, although one convenient location of infill well 6 is in alignment with wells 2 and 3. Similarly, it is not essential that well 6 be located exactly midway between injection well 2 and production well 3, and it is adequate for our purposes if a distance between injection well 2 and infill well 6 be from 25 to 75 percent and preferably from 40 to 60 percent of the distance between injection well 2 and production well 3. Infill well 6 is perforated or fluid flow communication is otherwise established between well 6 and the formation, only in the lower 50 percent and preferably in no more than the lower 25 percent or less of the formation. This is essential to the proper functioning of our process.

It is immaterial for the purpose of practicing our process, whether infill well 6 is drilled and completed at the same time as injection well 2 and production well 3, and/or if such drilling and completion of infill well 6 is deferred until steam breakthrough has occurred at production well 3, or some intermediate time. If completed prior to use, infill well 6 is simply shut in during the first phase of the process of our invention.

The fluid injected into injection well 2 during the first step described herein, as well as that injected into infill well 6 in the subsequent portion of the process of our invention, will comprise steam, although other substances may be used in combination with steam as is well described in the art. For example, noncondensible gases such as nitrogen or carbon dioxide may be comingled with steam for the purpose of improved oil stimulation or to achieve other objectives. Materials which are miscible in formation petroleum may also be mixed with the steam, such as hydrocarbons in the range of $C_1$ to $C_{10}$, for the purpose of further enhancing the mobilizing effect of the injected fluids. Air may also be comingled with steam in a ratio from 0.05 to 2.0 standard cubic feet of air per pound of steam, which accomplishes a low temperature, controlled oxidation within the formation, and achieves improved thermal efficiency under certain conditions. So long as the fluid injected into injection well 2 comprises a major portion of vapor phase steam, the problem of steam channeling will be experienced in the steam drive process no matter what other fluids are included in the injected steam, and the process of our invention may be incorporated into the steam drive oil recovery process with the resultant improvement in vertical conformance.

Turning again to the drawings, the process of our invention in its broadest aspect is applied in five stages to an oil formation. FIG. 2 illustrates a minimum three-well unit for employing the process of our invention, wherein formation 1 is penetrated by an injection well 2 which is in fluid communication with the full vertical thickness of the formation. Spaced-apart production well 3 is a dually completed production well, with one flow path in fluid communication with the upper $\frac{2}{3}$ or less of the vertical thickness of the formation. In this embodiment, the annular space between casing 8 at well 3 is used as the first communication path, while tubing 7 is used for the second communication path which is in fluid communication with less than all of the bottom $\frac{1}{3}$ of the formation. Other arrangements are, of course, possible. Infill well 6 is shown located about midpoint between well 2 and 3, and within the recovery zone defined by wells 2 and 3, i.e. on or adjacent to a line between wells 2 and 3, and fluid communication is established between well 6 and the lower portion of the formation, in this instance being about the bottom 25 percent of the total thickness of the formation.

In the first step, a thermal recovery fluid comprising steam is injected into the formation by means of injection well 2. Steam enters the portion of the formation immediately adjacent to well 2 through all of the perforations in well 2, and initially travels through substantially all of the full vertical thickness of formation 1. Because the specific gravity of vapor phase steam is significantly less than the specific gravity of other fluids, including the viscous petroleum present in the pore spaces of formation 1, steam vapors migrate in an upward direction due to gravitational effects, and as can be seen in FIG. 1, the portion 4 of the formation 1 swept by steam vapors in the first step represents an increasingly diminished portion of the vertical thickness of the formation as the steam travels between the injection well and production well 3. Thus by the time steam arrives at the upper perforations of production well 3, steam is passing through only a small fraction of the full vertical thickness of the formation. Oil is recovered from the upper portion of the formation through which the steam vapors travel, although the total recovery from the recovery zone defined by wells 2 and 3 will be significantly less than 50 percent of the total amount of petroleum in the recovery zone. Oil is produced to the surface via the communication path of well 3 in fluid communication with the upper part of the formation, which in this embodiment is the annulus between casing 8 and tubing 7 of well 3. Even though significantly more than 50 percent of the oil present in portion 4 of the formation is recovered by steam, the large amount of oil unrecovered from that portion 5 through which very little of the steam passes causes the overall recovery efficiency from the entire recovery zone to be very low. The recovery efficiency as a consequence of this problem is influenced by the thickness of the formation, the well spacing, and the viscosity of the petroleum present in the formation at initial conditions.

During at least a portion, and preferably during all of the time during which the above-described steam injection and oil production is occurring, a solvent injection-production sequence or push-pull process is applied to the bottom part of the formation adjacent the producing well by means of the flow path which communicates from the surface to the bottom $\frac{1}{3}$ or less of the producing well. This sequence comprises injecting solvent, alone or preferably in combination with hot water or steam, into the bottom portion of the formation via the flow path which communicates from the surface to the bottom zone of the producing well. Tubing of well 3 is used for this purpose in the embodiment depicted in FIG. 2. The fluid injected into the bottom zone is a solvent, preferably a hydrocarbon which is liquid at formation temperature and injection pressure. Suitable solvents include $C_2$ to $C_{10}$ and preferably $C_3$ to $C_7$ hydrocarbons including mixtures, as well as commercial mixtures such as kerosene, naphtha, natural gasoline, etc. The solvent may be injected alone or it may be used in combination with hot water or steam, either by injecting solvent and water in a mixture or in alternating slugs, etc. Solvent alone is quite effective but costly, and the embodiment employing a mixture or combination of solvent and hot water is the especially preferred embodiment.

The solvent and hot water or steam if used, is injected into the bottom zone adjacent to the production well by means of tubing 7 in the embodiment shown in FIG. 2. As solvent invades the formation, it dissolves viscous petroleum, forming a bank of petroleum and solvent in which the petroleum content increases as the bank moves away from the immediate vicinity of the production well. This phenomena can be detected by monitoring the injection pressure. It is desired to cease solvent injection and recover solvent and petroleum by backflowing into the well through the same perforations as were used for fluid injection, before the petroleum content of the solvent petroleum solution increases so much that the viscosity thereof becomes so great that the solution of petroleum and solvent will not flow readily back into the well. This can be done by limiting the volume of solvent injected in each cycle, although the permissible solvent volume increases as the total number of applied cycles increases. As a general guideline, the volume to be injected in the first few treatment cycles should be from 2,000 to 40,000 and preferably 4,000 to 10,000 gallons of solvent per foot of formation thickness being treated. This can be increased by from 5 to 500 and preferably from 50 to 100 percent each 1 or 2 cycles of solvent injection-fluid production. When solvent and hot water are used together the above volumes refer to the total volume of solvent and hot water.

Another method for determining when each step of solvent injection is ended and production begun involves monitoring the injection pressure. A preferred pressure end point is from 50 to 95 and preferably from 75 to 85 percent of the pressure which will cause fracture of the formation and/or overburden, if the value of this pressure is known. For example, if it is known that the fracture pressure of the formation at the depth where solvent injection is being applied is 1750 pounds per square inch, then each solvent injection sequence should be terminated when the injection pressure rises to a value from 1310 to 1490 pounds per square inch.

When solvent injection is terminated and fluid production (solvent, petroleum and water) is begun, the flow rate is usually quite high at first but declines rapidly as the drive pressure declines. Each fluid production step should be terminated after the production rate declines to a value from 2 to 10 percent of the initial flow rate, or when it declines to a value from 5 to 10 barrels per day.

The above sequence of solvent injection followed by fluid production is continued, each cycle resulting in greater penetration into the formation, and so requiring longer time periods per cycle and larger volumes of solvent. The result of applying a number of cycles is shown in FIG. 2 which depicts the condition in the formation at about the time when the first step in our process is completed. Steam breakthrough has occurred at the top of well 3 and the solvent depleted zone 9 adjacent the bottom of production well 3 is nearing the bottom of infill well 6. The end of step 1 is preferably based on breakthrough of live steam at the upper perforations in well 3. The solvent push-pull treatment is applied simultaneously with steam injection into well 2 and fluid production at the upper perforations of well 3, preferably during substantially all of the time which is required for steam drive up to steam breakthrough. Once steam is being produced in well 3, further production of oil will be at a much diminished rate, since the only mechanism by means of which additional oil can be recovered from the formation below the steam-swept zone 4 will be by a stripping action, in which oil is recovered along the surface 14 between the steam-swept portion 4 of the formation and portion 5 of the recovery zone through which steam has not passed. Although this mechanism may be continued for very long periods of time and additional oil can be recovered from zone 5 by this means, the stripping action is extremely inefficient and it is not an economically feasible means of recovering viscous oil from the formation after steam breakthrough occurs at well 3.

Figure 3:
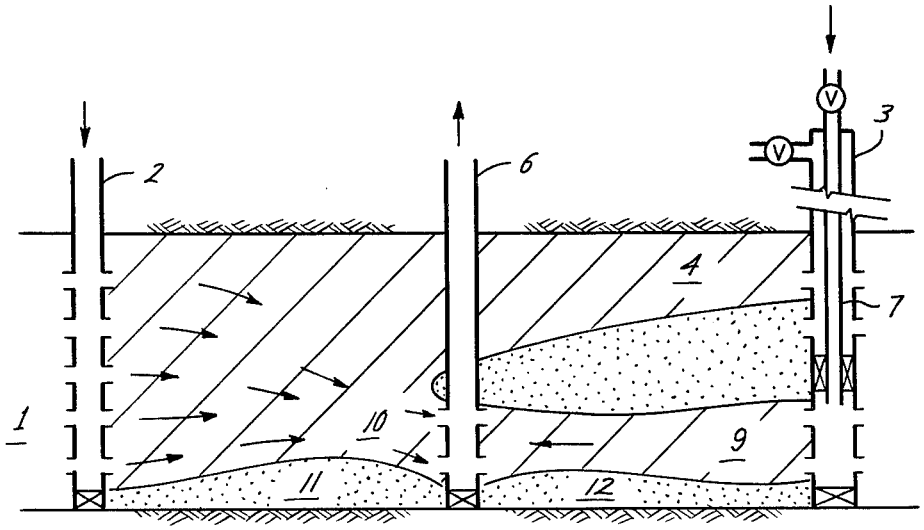
FIG. 3 illustrates the second phase of our process in which fluids are recovered from the formation by means of the infill well.

In the second step in the process of our invention, infill well 6 is utilized as a production well. It should be understood that a significant amount of oil is recovered from the formation by this step alone which is not recovered at the economic conclusion of the first step. We have found that the oil saturation in zone 10, that being the portion of the recovery zone between the infill well 6 and injection well 2, occupying the lower thickness of the formation, is actually increased during the period of recovering oil from swept zone 4 in FIG. 1. This is caused by migration of oil mobilized by injected steam, downward into the portion of the formation through which steam does not travel during this first period. Thus, if the average initial oil saturation throughout viscous oil formation 1 is in the range of about 55 percent (based on the pore volume), injection of steam into the formation will reduce the average oil saturation throughout depleted zone 4 to 15 percent, but the oil saturation in zone 10 will actually increase to a value from 60 to 70 percent. The second step in the process of our invention, in which fluids are recovered from infill well 6, accomplishes steam stimulated recovery of petroleum from zone 10 in the FIG. 3 which is not recoverable by processes taught in the prior art. Because fluid communication only exists between well 6 and the lower portion of the formation, at least the lower 50 percent and preferably the lower 25 percent of the formation, movement of oil into these perforations results in sweeping a portion of the formation not otherwise swept by steam. In FIG. 3, it can be seen that a portion 11 still remains unswept by the injected steam, but it is significantly less than the volume of zone 10 prior to application of the second step of the process of our invention. Some production of solvent and petroleum from zone 9 remaining from the first stage, may also occur. Once the water cut of the fluid being produced from the formation by means of well 6 increases to a predetermined value, preferably at least 95 percent, production of fluids from the formation by means of well 6 is terminated and well 6 is converted to an injection well.

During the above described second step of the process of our invention, steam injection into well 2 must, of course, be continued, and production of fluids from well 3 may be continued or may be discontinued depending on the water cut of fluid being produced at that time. Steam, hot water, solvent or a mixture thereof may also be injected into flow path 7 of well 3 during this step to augment expansion of depleted zone 9 to establish communication with infill well 6.

Figure 4:
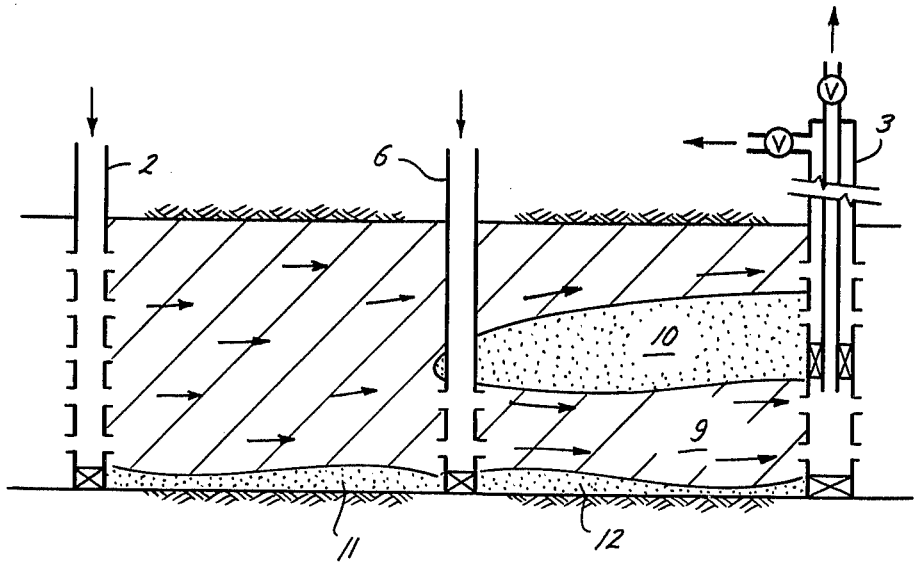
FIG. 4 illustrates the third step of the process of our invention in which hot water injection is being applied to the formation by means of the infill well, illustrating how water passes through the lower portion of the recovery zone in the formation between the infill well and the production well, enlarging the oil-depleted zone formed by the solvent push-pull process applied in the first step.

After conversion of infill well 6 from a producing well to an injection well, the third step comprises injected hot water into well 6 and taking fluid production from well 3. It is preferred that the fluid being injected into well 6 be substantially all in the liquid phase during this step of the process of our invention. The reason the fluid should be substantially all liquid phase is that gravity forces help ensure that the injected fluid travels in the lower portion of that zone of the recovery zone between infill well 6 and production well 3. This can be seen in FIG. 4, wherein the injected liquid travels principally through the lower portion of the section of the formation between infill well 6 and production well 3. During this step, production of fluids must be taken from well 3, preferably only from the bottom perforations of well 3, and continued injection of steam or water into well 2 must be continued. Because the specific gravity of liquid phase water is substantially greater than the specific gravity of vapor phase steam, the fluids are confined to the lower flow channels within zone 9 of the formation, and thus travel through a portion of the formation not contacted by vapor phase steam during the previous steps. Hot water mobilizes viscous petroleum, although its effectiveness is less than steam. Hot water injection will, however, further reduce the oil saturation in the lower portion of the zone between infill well 6 and production well 3, and will therefore increase the permeability of zone 9 of the formation. This effect further enlarges the flow channels in zone 9 first opened in the solvent push-pull treatment of step 1 above. Hot water injection is continued until the water cut of the fluid being produced from well 3 rises to a value greater than about 80 percent and preferably greater than a value of about 95 percent. This ensures the optimum desaturation of the lower portion of the zone 9 between infill well 6 and production well 3 which is necessary to increase the permeability of that section of the recovery zone sufficiently that the next phase of the process can be successful.

In a slightly different preferred embodiment of the process of our invention, the fluid being injected into well 6 in the foregoing steps comprises a mixture of hot liquid phase water and a hydrocarbon solvent. In this embodiment, it is preferred that the hydrocarbon be in the liquid phase to ensure that it travels through substantially the same flow channels as the liquid phase water, and so the boiling point of the hydrocarbons should be below the temperature of the hot water being injected into the formation. One especially preferred hydrocarbon for this purpose comprises the hydrocarbons being separated from produced fluids in the same or other zones in the formation as a consequence of steam distillation. This is an optimum hydrocarbon solvent for this purpose, possibly because the material is necessarily fully miscible with the formation petroleum, having been obtained therefrom by steam distillation.

Figure 5:
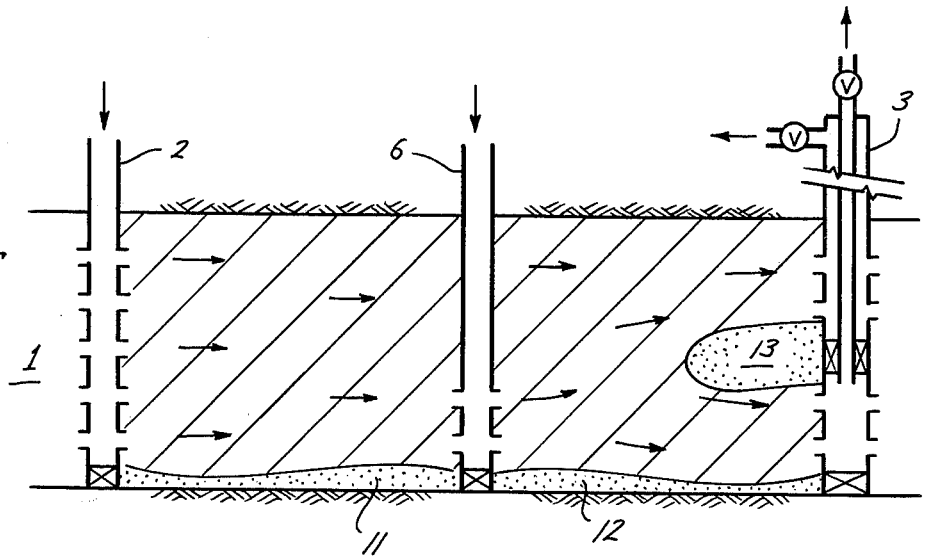
FIG. 5 illustrates the fourth step of the process of our invention in which steam is injected into the infill well, said steam passing through both the upper and lower zones of the recovery zone between the infill well and the production well, with fluid production being taken from the top and bottom perforations of the production well.

After the water cut of fluids being produced from well 3 during this phase of the process of our invention reaches the above-described levels, injection of hot liquid phase water into infill well 6 is terminated and the fourth step comprising steam injection into infill well 6 is thereafter initiated. Production of fluids is taken initially from both communication paths of well 3 at the beginning of the fourth step as is shown in FIG. 5. Because of the previous step, during which hot water injection passed through zone 9 in the lower portion of the formation between infill well 6 and producing well 3, at least a portion of the steam being injected into infill well 6 passes through the lower portion of the formation. It must be appreciated that steam would not travel through the lower portion of the formation under these conditions if the solvent push-pull in step 1 or hot water had not first been injected for the purpose of desaturating the lower portion of the zone between wells 6 and 3 in step 3, which established a zone of increased permeability, thereby ensuring that the flow channel permeability is sufficient that at least a portion of the steam will pass through the lower portions of the formation. This will result in some steam underriding the residual oil in the zone 10 between wells 6 and 3, although a degree of steam override may be encountered in this portion of the process as communication between the point where steam is entering the formation through perforations in well 6 and previously depleted zone 4 occurs. Steam injection is continued, and the oil production rate is significantly better as a result of the previous formation of flow channels in the zone 9 of the formation, since the stripping action is more efficient with respect to overlying oil saturated intervals than it is with respect to an underlying oil saturated interval. The reasons for this involve the fact that oil mobilized by contact with the hot fluid passing under an oil saturated interval migrates downward by gravitational forces into the flow channel, and also because steam movement occurs in an upward direction into the oil-saturated interval more readily than downward, due to gravitational forces.

Figure 6:
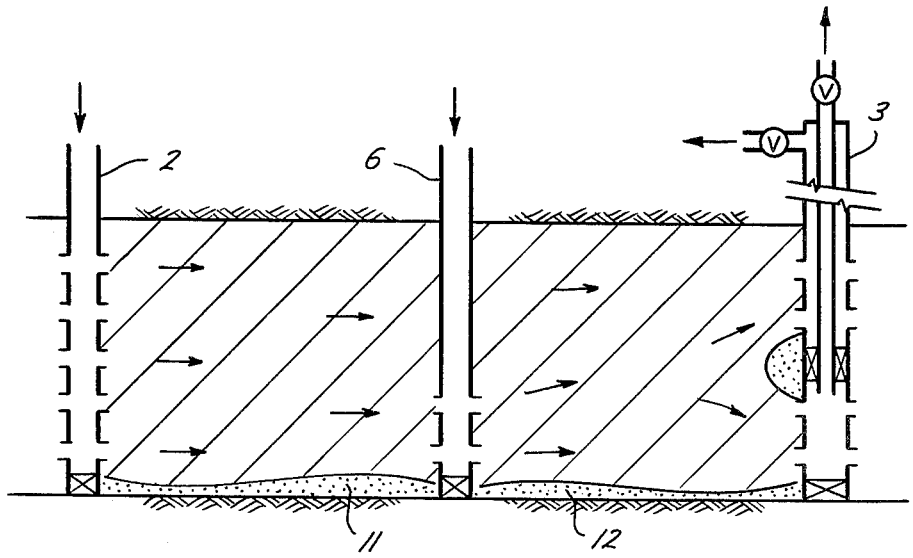
FIG. 6 illustrates the fifth step in the process of our invention in which steam injection into both the infill well and injection well is continued and production is taken only from the bottom perforations in the production well.

The water cut of fluids being taken from the top of the formation will ordinarily rise to a predetermined cut off value quicker than will occur at the bottom perforations of well 3, for the reasons discussed above. When this occurs, the flow path in communication with the top of the formation is shut in and essentially all of the production thereafter is taken from the bottom. The above described fourth step is continued with steam being injected into infill well 6 and fluid production being taken from the bottom perforations of well 3, until steam or steam condensate production at well 3 occurs to a predetermined extent. This step is preferably continued until the water cut of fluids being taken from the bottom formation by well 3 reaches a value greater than 80 percent and preferably at least 95 percent. Fluid injection into well 2 during this step is continued in order to ensure maintenance of a positive pressure gradient from the injector to infill well to producer, to prevent migration of oil from the infill well toward the injection well. Steam may be injected although hot water is preferred because saturation of the pore spaces between injector and infill well helps prevent oil migration thereinto. The volume injection rate at the injector should be greater than at the infill well, preferably at least twice again. The conditions in the reservoir at the end of step 4 is shown in FIG. 6.

EXPERIMENTAL EVALUATION

For the purpose of demonstrating the magnitude of results achieved from application of a process employing the basic concepts of infill well use employed in embodiments of our invention, the following laboratory experiments were performed.

A laboratory cell was constructed, the cell being 3 inches wide, 8½ inches high and 18½ inches long. The cell is equipped with three wells, an injection well and production well in fluid communication with the full height of the cell and a central infill well which is in fluid communication with lower 15 percent of the cell, the well arrangement being similar to that shown in FIG. 2. A base steam drive flood (without using the infill well) was conducted in the cell to demonstrate the magnitude of the steam override condition. The cell was first packed with sand and saturated with 14 degree API gravity crude to initial oil saturation of 53.0 percent. The infill well was not used in the first run, this run being used to simulate a conventional throughput process according to the steam drive processes described in the prior art. After steam injection into the injection well and fluid production from the production well continued to a normal economic limit, the average residual oil saturation in the cell was 46.3 percent. In the second run, a process employing use of an infill well was applied to the cell, with steam being injected into the injection well and oil production taken from the production well until live steam breakthrough was detected at the production well, followed by production from the infill well, followed by first injecting cold water, then hot water and then steam into the cell by means of the infill well and recovering fluid from the producing well to a water cut of 98 percent. The overall residual oil saturation at the conclusion of this run was 30.1 percent compared with the initial oil saturation of 53 percent in both cases, it can be seen that the base flood recovered only 12.6 percent of the oil present in the cell whereas application of a steam drive process making use of infill wells resulted in recovering 43 percent of the oil, or about 3.4 times as much oil as the base run.

Thus we have disclosed and demonstrated how significantly more viscous oil may be recovered from an oil formation by a throughput, steam drive process by employing the process of our invention with infill wells located between injection and production wells, and a multi-step process as described herein. While our invention is described in terms of a number of illustrative embodiments, it is clearly not so limited since many variations of this process will be apparent to persons skilled in the art of viscous oil recovery methods without departing from the true spirit and scope of our invention. Similarly, while mechanisms have been discussed in the foregoing description of the process of our invention, these are offered only for the purpose of complete disclosure and is not our desire to be bound or restricted to any particular theory of operation of the process of our invention. It is our desire and intention that our invention be limited and restricted only by those limitations and restrictions appearing in the claims appended immediately hereinafter below.

We claim:

1. A method of recovering viscous oil from a subterranean, permeable, viscous oil-containing formation, said formation being penetrated by at least three wells, one injection well and one production well, said injection well being in fluid communication with a substantial portion of the formation, said production well containing two flow paths from the surface, the first being in fluid communication with the upper $\frac{2}{3}$ or less of the formation, and the second being in fluid communication with the bottom $\frac{1}{3}$ or less of the formation, and an infill well located between the injection well and production well in fluid communication with no more than the lower 50 percent of the recovery zone defined by the injection and production wells, comprising:

(a) injecting a thermal oil recovery fluid comprising steam into the injection well and recovering fluid including oil from the formation by the first flow path in the production well until the fluid being recovered from the production well comprises a predetermined amount of steam or water;

(b) simultaneously injecting a predetermined volume of a solvent or a mixture of solvent and hot water or steam, said solvent being liquid at injection conditions, into the formation via the second flow path of the production well;

(c) recovering fluids including solvent and petroleum from the formation via the second flow path;

(d) repeating steps (b) and (c) for a plurality of cycles;

(e) thereafter continuing injecting a thermal oil recovery fluid into the injection well and recovering fluids including oil from the formation by the infill well until the fluid being recovered comprises a predetermined fraction of steam or water;

(f) thereafter injecting hot water into the infill well while continuing injecting a thermal recovery fluid into the injection well and recovering fluids from the formation by means of the second flow path in the production well until the percentage of water in the fluids being recovered reaches a predetermined value; and thereafter (g) injecting a thermal recovery fluid comprising steam into the infill well and injecting a fluid into the injection well and recovering fluids from the formation via both flow paths in the production well initially until the fluids being recovered comprise at least 80 percent water.

2. A method as recited in claim 1 comprising the additional step of ceasing production of fluids from the first flow path when the water cut of fluids being produced therefrom reaches a predetermined level in step (g) and continuing producing fluids from the second flow path until the water cut of fluids being produced thereat reaches a predetermined level.

3. A method as recited in claim 1 wherein injection into the formation according to step (a) is continued until vapor phase steam production occurs at the production well.

4. A method as recited in claim 1 wherein the production of fluids from the formation by the infill well according to step (e) is continued until the percentage of water of said fluids rises to a value of at least 80 percent.

5. A method as recited in claim 4 wherein fluid production from the infill well is continued until the water content reaches 95 percent.

6. A method as recited in claim 1 wherein hot water injection into the infill well is continued until the percentage of water in the fluid being recovered from the formation via the production well rises to a value of at least 95 percent.

7. A method as recited in claim 1 wherein the step of injecting steam into the infill well as defined in step (g) is continued until the fluid being recovered from the formation is at least 95 percent water.

8. A method as recited in claim 1 wherein the thermal fluid injected into the formation via the injection well comprises a mixture of steam and hydrocarbon.

9. A method as recited in claim 8 wherein the hydrocarbon comprises $C_1$ to $C_{10}$ hydrocarbons.

10. A method as recited in claim 8 wherein the boiling point of the hydrocarbon is less than the temperature of the hot water being injected into the infill well.

11. A method as recited in claim 1 wherein the solvent injected into the formation via the second flow path in step (b) comprises a mixture of steam and solvent.

12. A method as recited in claim 1 wherein the solvent of step (b) is a $C_3$ to $C_{12}$ hydrocarbon including mixtures thereof.

13. A method as recited in claim 1 wherein the solvent of step (b) is a $C_4$ to $C_7$ hydrocarbon including mixtures thereof.

14. A method as recited in claim 1 wherein steps (b) and (c) are repeated throughout successive cycles during substantially the entire period during which steam is injected into the injection well and fluids are produced via the first flow path of the production well.

15. A method as recited in claim 1 wherein fluid production via the second flow path in step (c) is continued until the production flow rate drops to a value which is from 2 to 10 percent of the injected flow rate.

16. A method as recited in claim 1 wherein the volume of solvent injected in the first cycle of step (b) is from 1000 to 40,000 gallons per foot of formation thickness with which the second flow path is in communication.

17. A method as recited in claim 1 wherein the volume of solvent injected in the first cycle of step (b) is from 2000 to 10,000 gallons per foot of formation thickness with which the second flow path is in communication.

18. A method as recited in claim 1 wherein the rate of fluid injection into the injection well in step (g) exceeds the rate at which thermal recovery fluid is being injected into the infill well.

19. A method as recited in claim 18 wherein the fluid injection rate at the injection well is at least twice the rate of fluid injection at the infill well.

20. A method as recited in either claim 18 or 19 wherein the fluid injected into the injection well is hot water.

* * * * *